US005107827A

United States Patent [19]

Boyd

[11] Patent Number: 5,107,827

[45] Date of Patent: Apr. 28, 1992

[54] EQUINE LIMB BANDAGE

[76] Inventor: Timothy J. I. Boyd, Murrabong, Via Young, New South Wales, 2594, Australia

[21] Appl. No.: 439,375

[22] PCT Filed: Feb. 23, 1989

[86] PCT No.: PCT/AU89/00071

§ 371 Date: Nov. 27, 1989

§ 102(e) Date: Nov. 27, 1989

[87] PCT Pub. No.: WO89/07915

PCT Pub. Date: Sep. 8, 1989

[30] Foreign Application Priority Data

Feb. 26, 1988 [AU] Australia ..... PI6976
Oct. 13, 1988 [AU] Australia ..... PJ0929

[51] Int. Cl.[5] ..... A61F 13/00

[52] U.S. Cl. ..... 602/58; 602/62; 602/76

[58] Field of Search ..... 128/157, 165, 166, 80 A, 128/80 B, 80 F, 80 H; 606/212

[56] References Cited

U.S. PATENT DOCUMENTS

| | | | |
|---|---|---|---|
| 2,310,082 | 2/1943 | Holbrooke | 128/156 |
| 3,209,517 | 10/1965 | Hyman | 128/165 |
| 3,463,147 | 8/1969 | Stubbs | 128/165 |
| 3,506,000 | 4/1970 | Baker | 128/166 |
| 3,508,544 | 4/1970 | Moore et al. | 128/157 |
| 3,512,776 | 5/1970 | Thomas, Sr. | 128/165 |
| 3,937,218 | 2/1976 | Gaylord, Jr. . | |
| 4,085,746 | 4/1978 | Castiglia | 128/166 |
| 4,290,487 | 9/1981 | Unger | 54/82 |
| 4,370,978 | 2/1983 | Palumbo | 128/165 |
| 4,550,724 | 11/1985 | Berrehail | 128/165 |
| 4,961,418 | 10/1990 | McLaurin-Smith | 128/157 |

FOREIGN PATENT DOCUMENTS

| | | |
|---|---|---|
| 95638 | 9/1939 | Australia . |
| 6340160 | 2/1961 | Australia . |
| 4663185 | 3/1986 | Australia . |
| 1427188 | 8/1988 | Australia . |
| 2116810 | 7/1972 | France . |
| 2494582 | 5/1982 | France . |
| 2570273 | 3/1986 | France . |
| 1530313 | 10/1978 | United Kingdom . |
| 8809649 | 12/1988 | World Int. Prop. O. . |

*Primary Examiner*—Randall L. Green
*Assistant Examiner*—Paul Prebilic
*Attorney, Agent, or Firm*—Oblon, Spivak, McClelland, Maier & Neustadt

[57] ABSTRACT

An equine limb bandage comprises a length of at least partially elastic flexible sheet material having at least one zone of loops adapted to engage at least one zone of small plastic hooks. At least one zone of said hooks disposed thereon such that the bandage can be elastically stretched and wrapped around a limb with the loop zones at least partially overlying, and thus engaging, the hook zones to prevent loosening of the bandage. The hook and loop zones are disposed such that, in use, successive wraps of the bandage results in successive overlapping of hooks and loops so that each wrap is secured under tension to an immediately adjacent underlying wrap.

8 Claims, 12 Drawing Sheets

EQUINE LIMB BANDAGE

TECHNICAL FIELD

This invention relates to bandages and in particular to an equine limb bandage.

BACKGROUND ART

Leg bandages are frequently used on horses and particularly on polo horses, show jumping and race horses for protective and therapeutic purposes. These bandages are generally wrapped around the animal's leg and extend between the knee and the fetlock. The bandages take several forms but most are prone to loosening when the horse is worked because while the ends of the bandage are secured, the overlying wraps rely largely on frictional contact to keep them in place.

In addition, when some horses are galloping, the back legs reach forward to such an extent that the rear of the fetlock joint often hits the ground. In the past these areas have sometimes been protected using "sticking plaster" or similar material. However, materials such as this provide limited protection for the joint and are readily worn away by repeated contact with the ground as the horse gallops.

DISCLOSURE OF INVENTION

It is one object of the present invention to provide an equine limb bandage which overcomes or substantially ameliorates one or more of these disadvantages.

According to the invention there is provided an equine limb bandage comprising a length of at least partially elastic sheet material, said sheet material having at least one zone of loops adapted to engage small plastics hooks of the kind used in hook and loop fastenings, and at least one zone of said hooks disposed thereon such that the bandage can be elastically stretched and wrapped around a horses limb with the loop zones at least partially overlying, and thus engaging, the hook zones to prevent loosening of the bandage.

Preferably the bandage includes a plurality of hook and loop zones disposed such that successive wraps of the bandage result in successive overlapping of hooks and loops so that each wrap is secured to the previous wrap.

The bandage preferably contains a zone of loops extending substantially over one entire side thereof, and a plurality of discrete hook zones spaced apart along the length of the bandage and positioned such that each successive wrap of the bandage is secured to the previous wrap. This feature obviates the need for the discrete hook and loop zones to be accurately positioned such that the respective hook and loop zones come into alignment as the bandage is progressively wrapped. This feature also provides a bandage suitable for a wide range of limb sizes.

In one embodiment the bandage is generally rectangular with both the hook and loop zones on one side, the hook zone being adjacent one end so that the bandage can be applied with the end portion running along a limb and at least part of the remainder of the bandage wrapped around and along the limb overlying the end portion.

In another embodiment the bandage is in a generally L-shape formed by a short perpendicular extension at one end. The extension has a hook zone on the side of the bandage opposite to the loop zone so that the bandage can be applied with the extension running along a limb and the remainder of the bandage wrapped around and along the limb overlying the extension.

In another embodiment, the bandage incorporates a flexible bulbous cup formation adapted to conform to the projecting bumper associated with the fetlock joint of a horse, to provide additional support and protection to the joint.

The bandage is preferably formed from neoprene material which is commercially available with a nylon backing containing loops adapted to engage with small fastenings. The hook zones preferably comprise sections of commercially available hook material such as that sold under the trade mark "VELCRO" and which are affixed by sewing, gluing or the like.

One advantage of the equine limb bandage of the present invention is that the bandage retains its resiliency after constant use. Other known bandages have a tendency to lose their elasticity after use and can no longer stretch to accomodate flexing and movement of the limb or joint. This situation can cause injury to the horse.

Four embodiments of this invention will now be described by way of example only, with reference to the accompanying drawings.

MODES FOR CARRYING OUT THE INVENTION

Figures 1, 2:
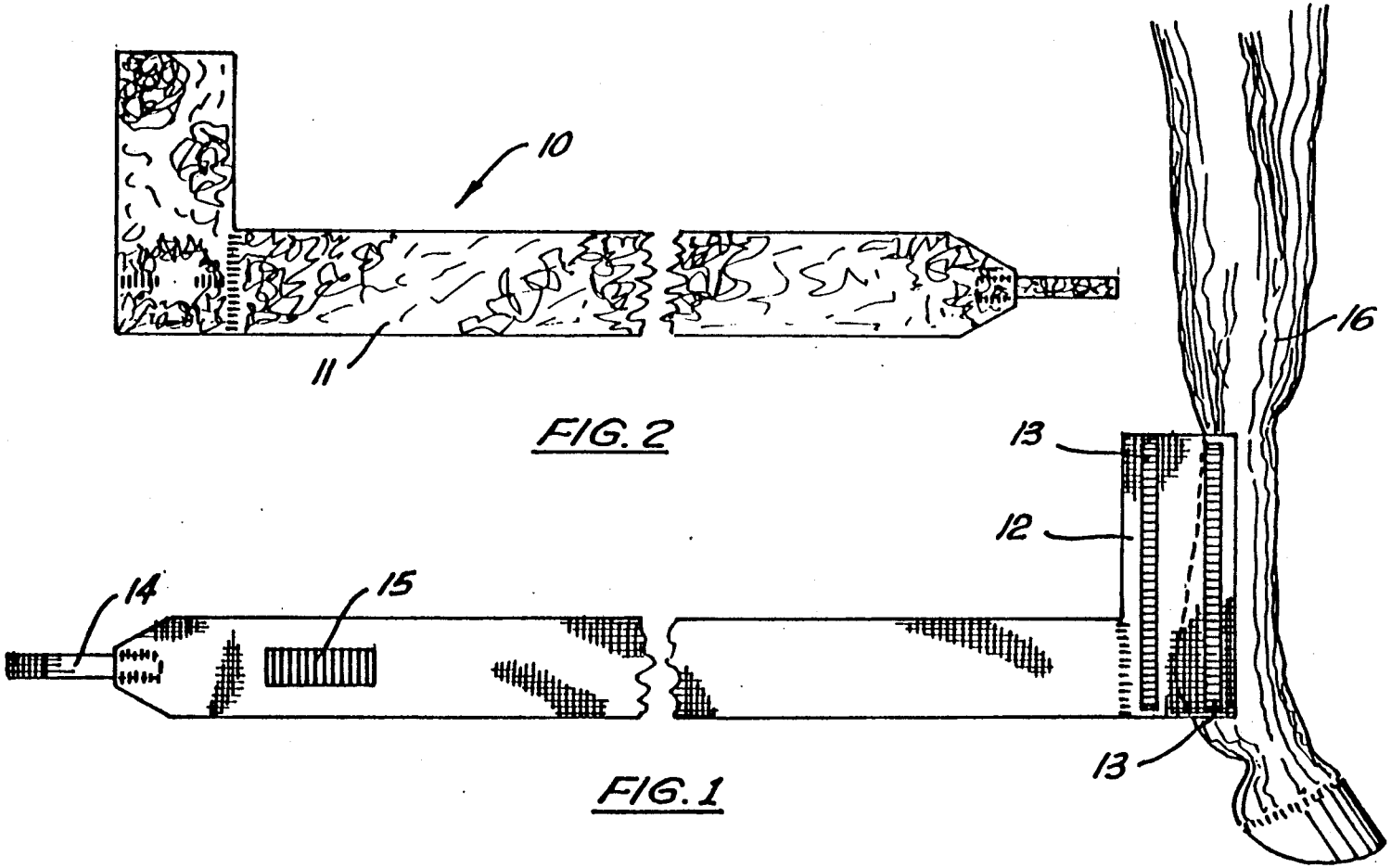
FIG. 1 shows a bandage according to a first embodiment ready for application to the leg of a horse.
FIG. 2 shows the reverse side of the bandage shown in FIG. 1.
Figure 3:
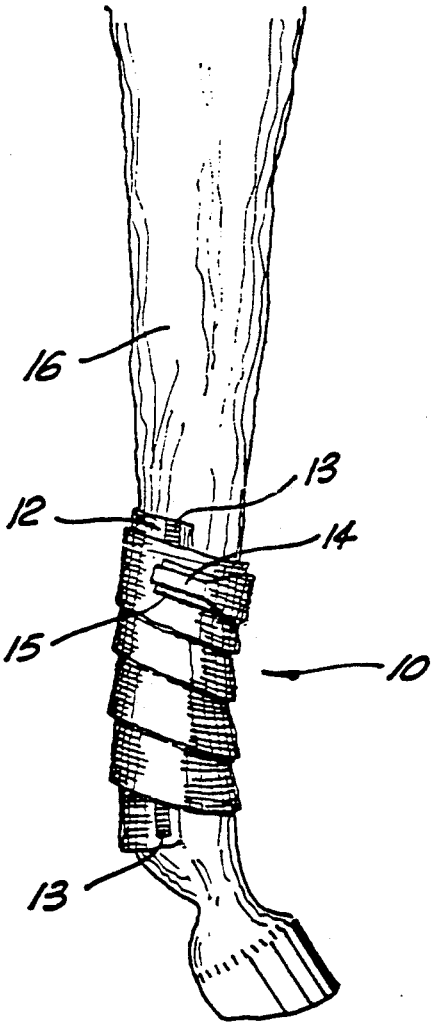
FIG. 3 shows the bandage of FIGS. 1 and 2 applied to the leg of a horse.
Figure 4:
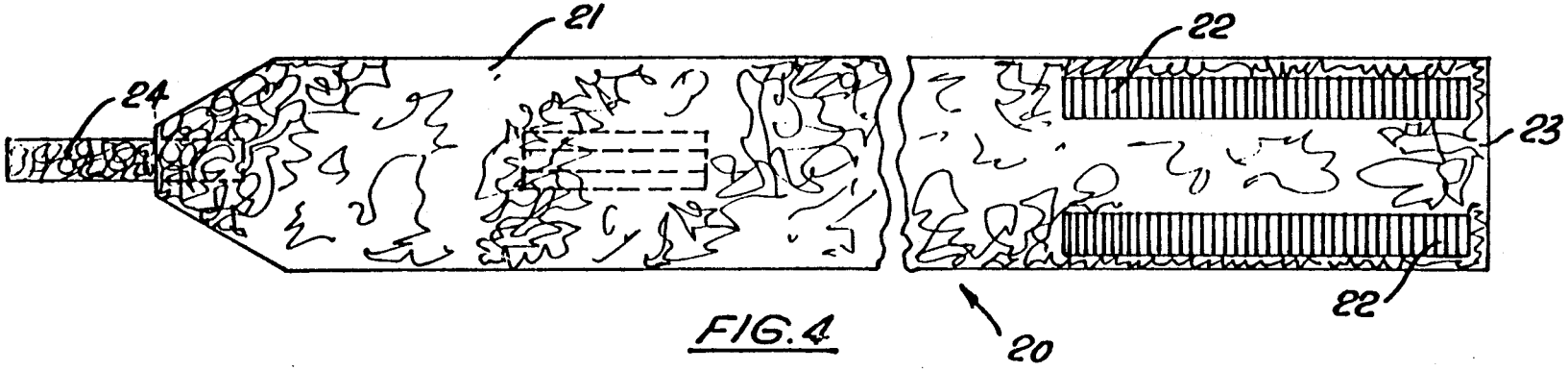
FIG. 4 shows a bandage according to a second embodiment of this invention.
Figure 5:
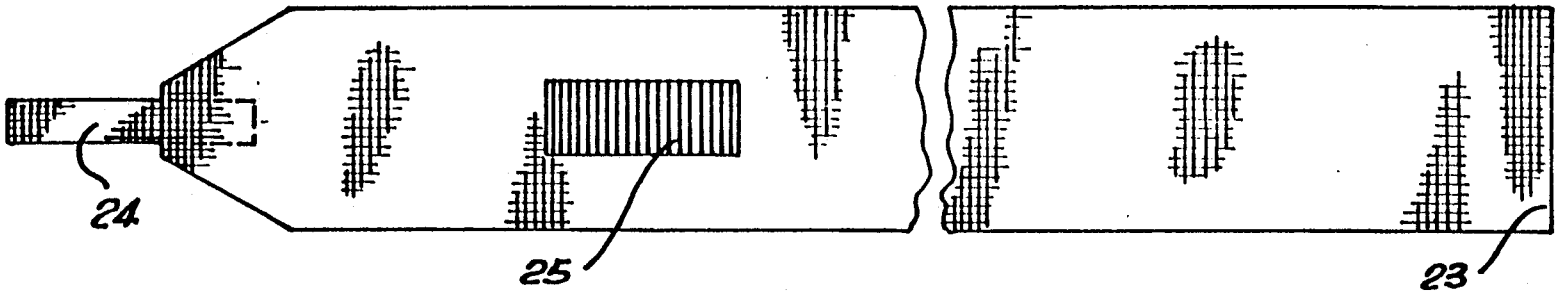
FIG. 5 shows the reverse side of the bandage shown in FIG. 4.
Figure 8:
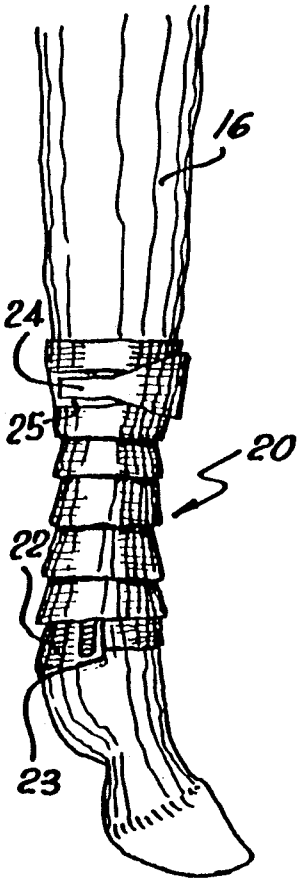
FIGS. 6 to 8 show the method of applying the bandage of FIGS. 4 and 5 to the leg of a horse.

Referring to FIGS. 1,2 and 3, the bandage 10 according to a first embodiment of this invention comprises a length of a sheet neoprene material cut to form an L-shape. The neoprene is of a commercially available type which has a nylon backing layer shown at 11 which contains loops adapted to engage with small plastics hooks of the kind used for hook and loop fastenings.

The backing 11 thus forms a zone of loops extending over the whole of one side of bandage 10. The L-shape is formed by a short perpendicular extension 12 at one end of the bandage 10. Two zones 13 of hooks of the kind used for hook and loop fastenings extend along extension 12 on the side of the bandage opposite the backing or loops 11. The small plastics hooks are formed on strips of commercially available material such as that sold under the trade mark "VELCRO" and which are affixed to the bandage by stitching.

The end of bandage 10 remote from extension 12 has a tab 14 of loop material of the kind used for hook and loop fastenings extending therefrom. The tab also is a section of loop strip sold under the trade mark "VELCRO" sewn or otherwise attached to the end of bandage 12. A further section of hook material 15 is sewn or otherwise affixed to bandage 10 a distance from tab 14 to provide for securing of the bandage as will be described below.

In use the bandage 10 is applied to the leg 16 of a horse in the following manner. The bandage is initially positioned with extension 12 running along the back of the horses leg between the knee and fetlock more or less as shown in FIG. 1. The extension 12 is held against the leg while the remainder of the bandage is wrapped around both the leg and the extension. Each successive wrap partly overlaps the previous wrap as shown in FIG. 3 so that the bandage extends spirally upwards. The neoprene material is elastic and so can be stretched as it is applied so as to form a tight bandage. The end of the bandage is secured to itself by means of tab 14 being attached to section 15 at the end of the wrap.

It will be apparent that as the bandage is wrapped onto the animal's leg each successive wrap overlies extension 12 in such a way that the loops of backing 11 on respective portions of the bandage engage with some of the hook zones 13 on extension 12. In this way each successive wrap is secured and the bandage is not prone to loosening when the animal is worked.

It will be apparent that the bandage can be used in both protective or therapeutic functions. In its therapeutic function the bandage provides additional support and warmth and is particularly suitable for veterinary use. In addition the extension 12 runs along the rear of the animal's leg thus providing further insulation and warmth to the tendon area.

In therapeutic applications the bandage can also be soaked in water which is absorbed by the neoprene and then chilled and frozen to provide a "cold pack" for injured animals.

FIGS. 4 to 8 show a bandage 20 according to a second embodiment of this invention. The bandage 20 comprises a generally rectangular section of neoprene sheet material of the kind described above for the first embodiment. As above the neoprene has a backing 21 containing small loops adapted to engage with small plastics hooks of the kind used for hook and loops extending over substantially all of one side of the bandage.

Two zones 22 of hooks extend a distance from one end 23 of the bandage 20. As with the first embodiment the zones of hooks are formed by a strip of hook material the kind used for hook and loop fastenings and sold under the trade mark "VELCRO". These strips are attached by stitching to the neoprene material. It will be noted that in contrast to the first embodiment the hook zones 22 are placed on the same side of the bandage as the loop zone or backing 21.

A tab 24 is attached to the end of the bandage 20 remote from hook zones 22. The tab is similarly formed from a section of loop material of the kind used for hook and loop fastenings and sold under the trade mark "VELCRO" which is attached to the bandage by stitching or other suitable means. A further section of hook material 25 is provided on the side of bandage 20 opposite the loop zone 21 and hook zones 22 for securing of the tab 24 as described below.

Figure 7:
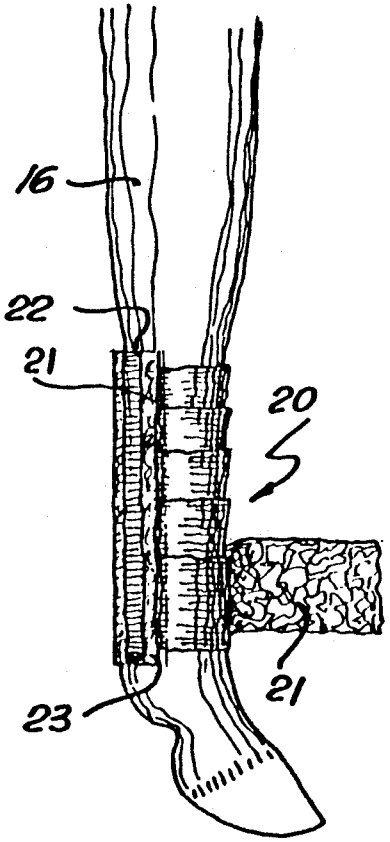
Figure 6:
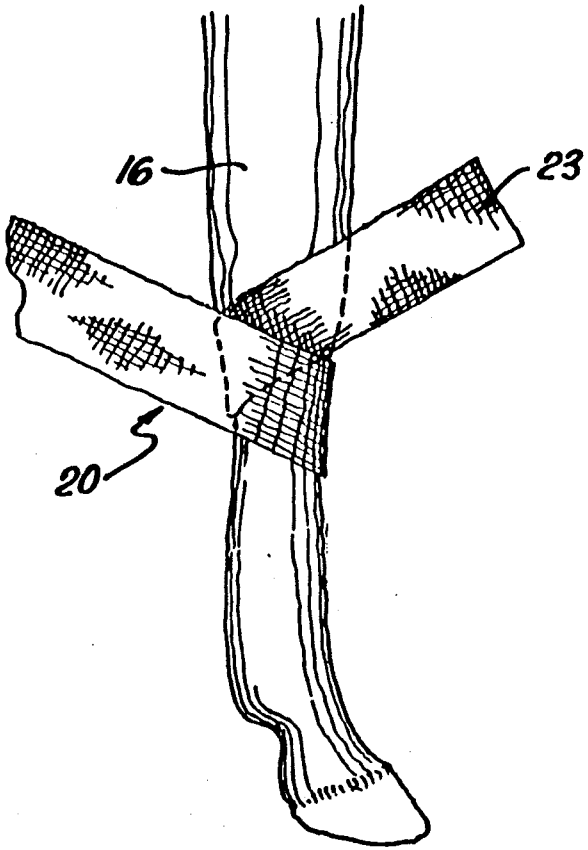
Figure 9:
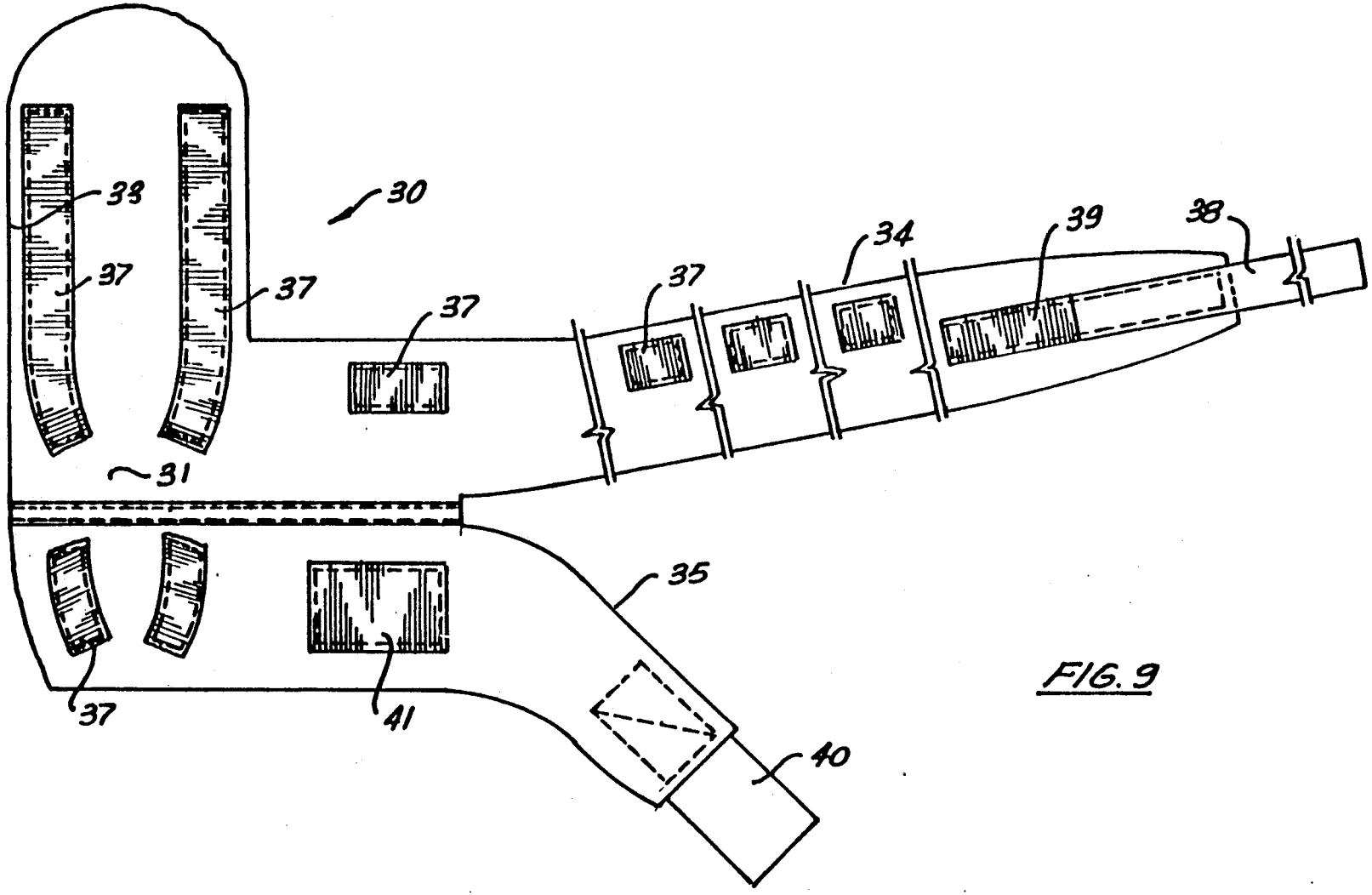
FIG. 9 is a plan view of a bandage having a resilient cup formation according to a third embodiment of the invention.
Figure 10:
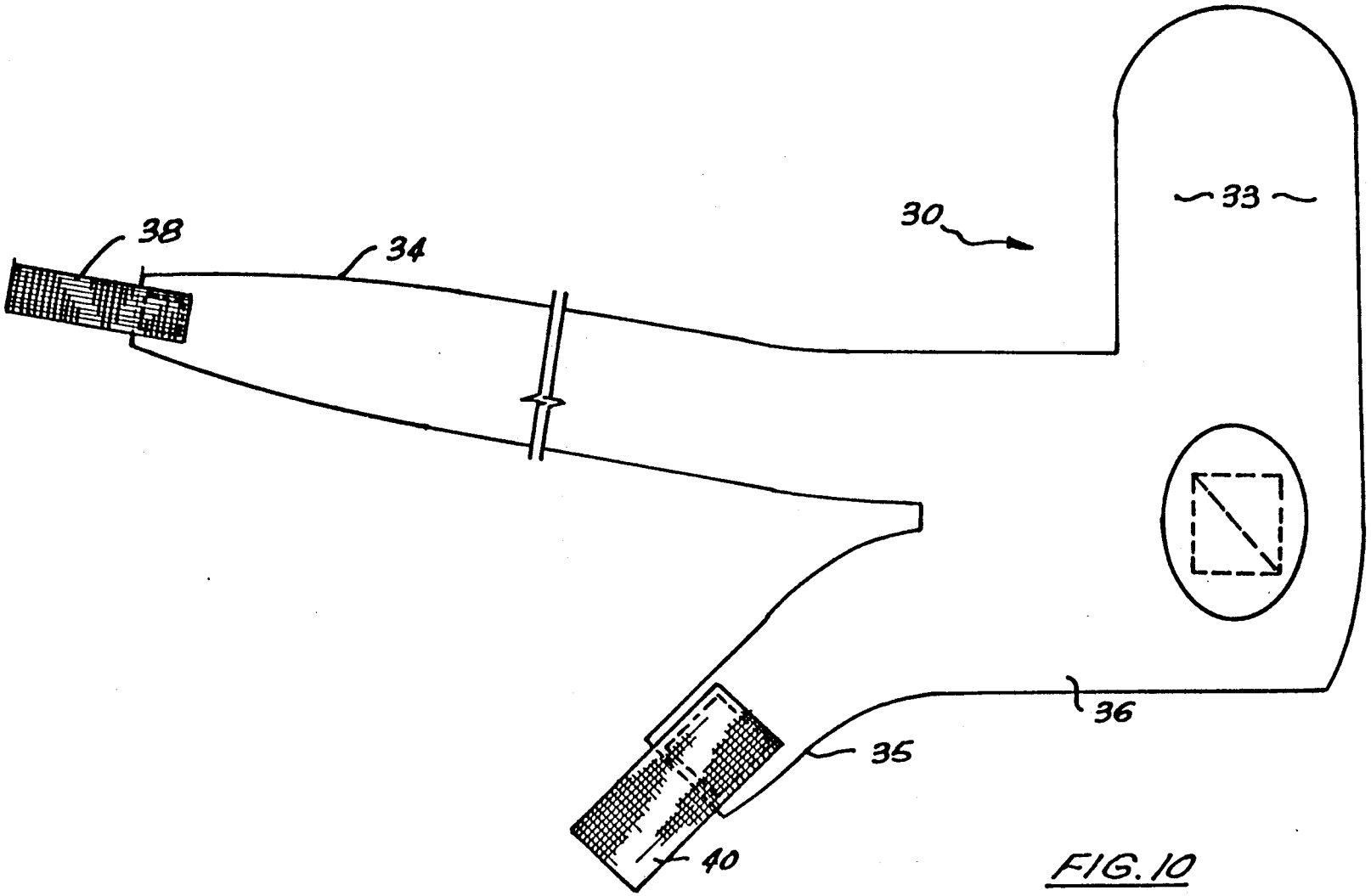
FIG. 10 shows the reverse side of the bandage of FIG. 9.
Figure 11:
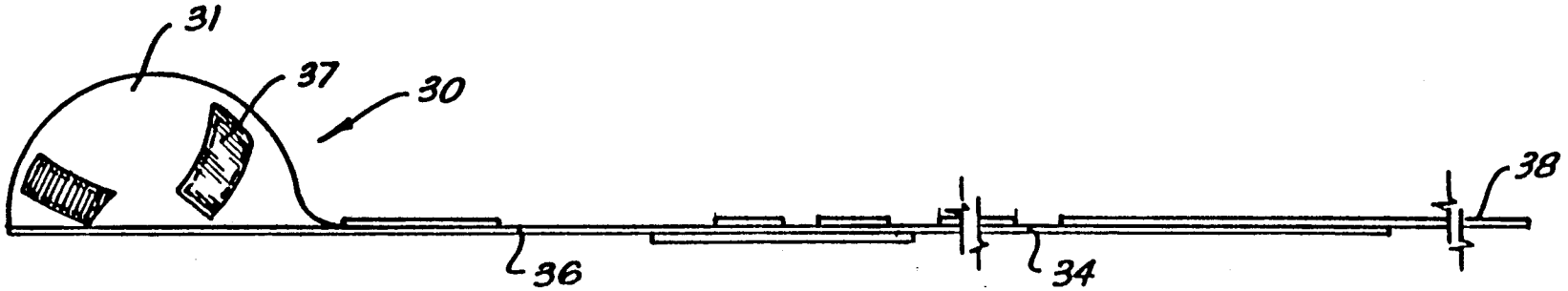
FIG. 11 is a side elevation of the bandage of FIG. 9.
Figure 12:
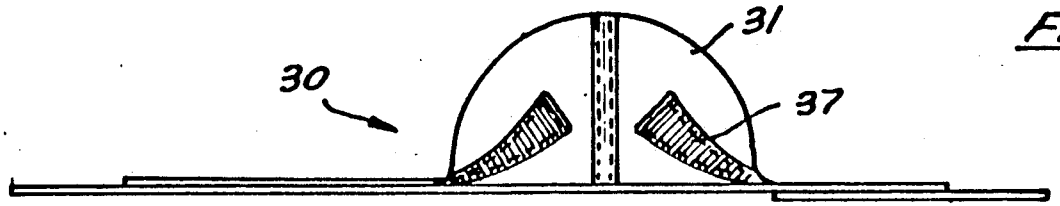
FIG. 12 is an end elevation of the bandage of FIG. 9.
Figure 13:
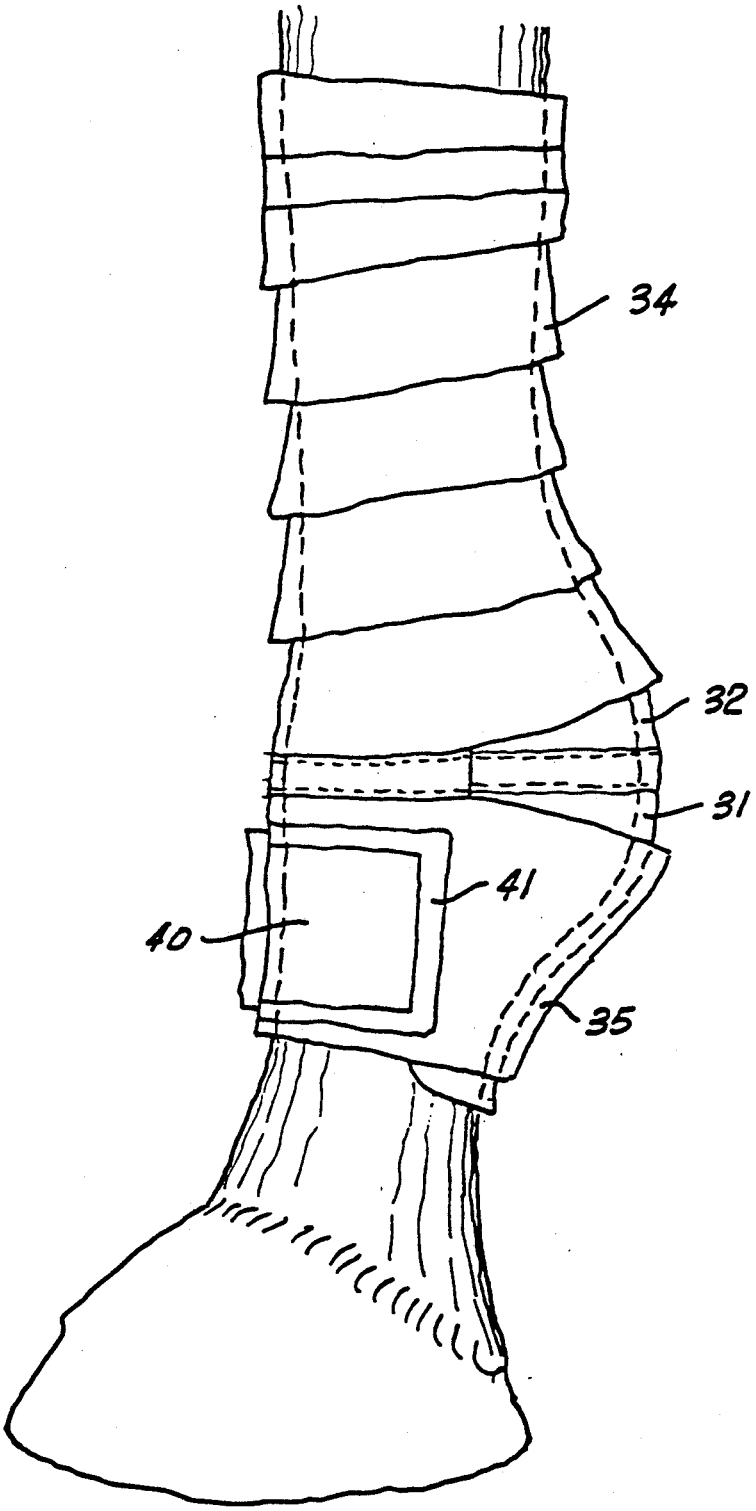
FIG. 13 shows the bandage of FIGS. 9 to 12 applied around the fetlock joint of a horse.
Figure 14:
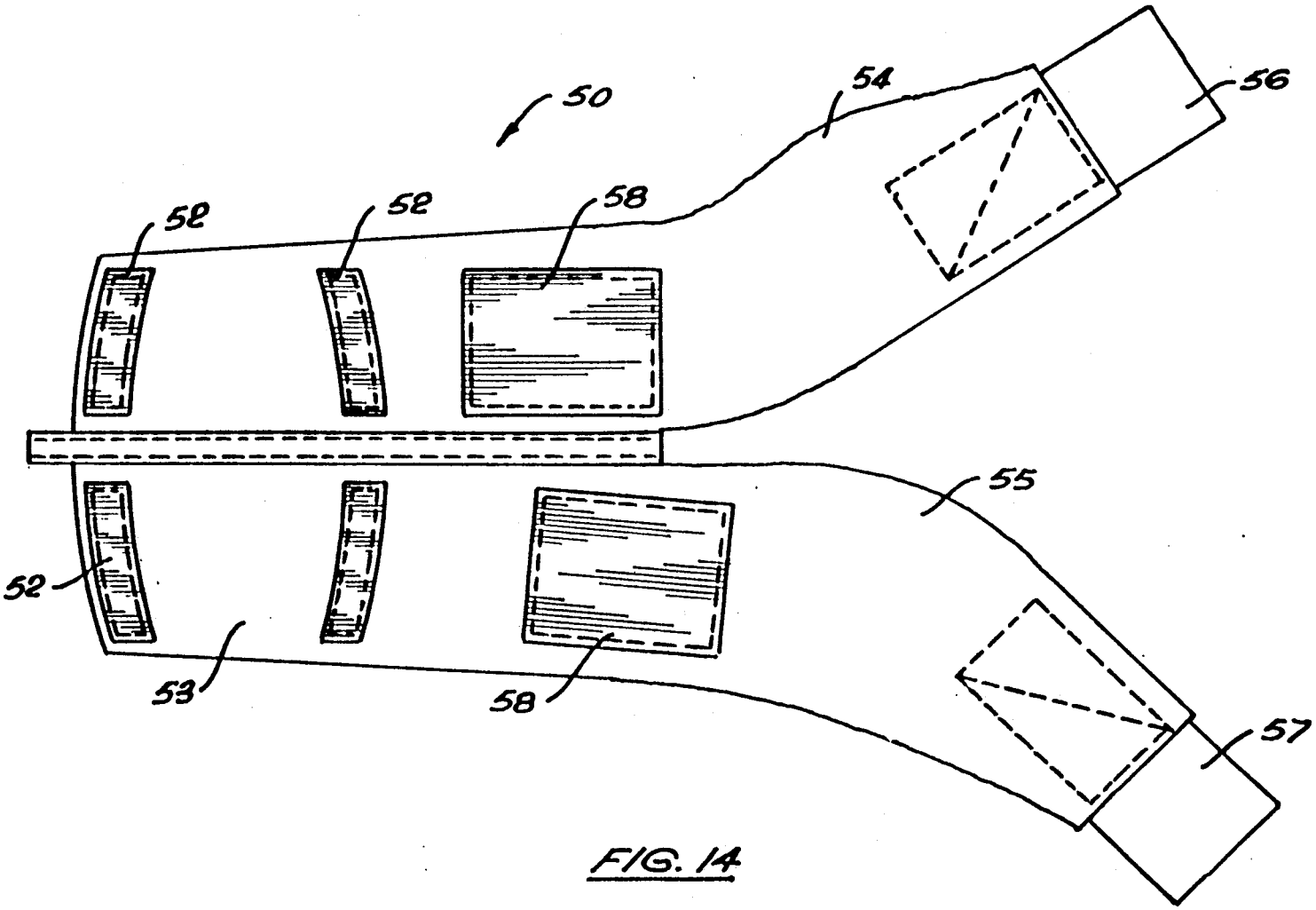
FIG. 14 is a plan view of a bandage having a resilient cup formation according to a fourth embodiment of the invention.
Figure 15:
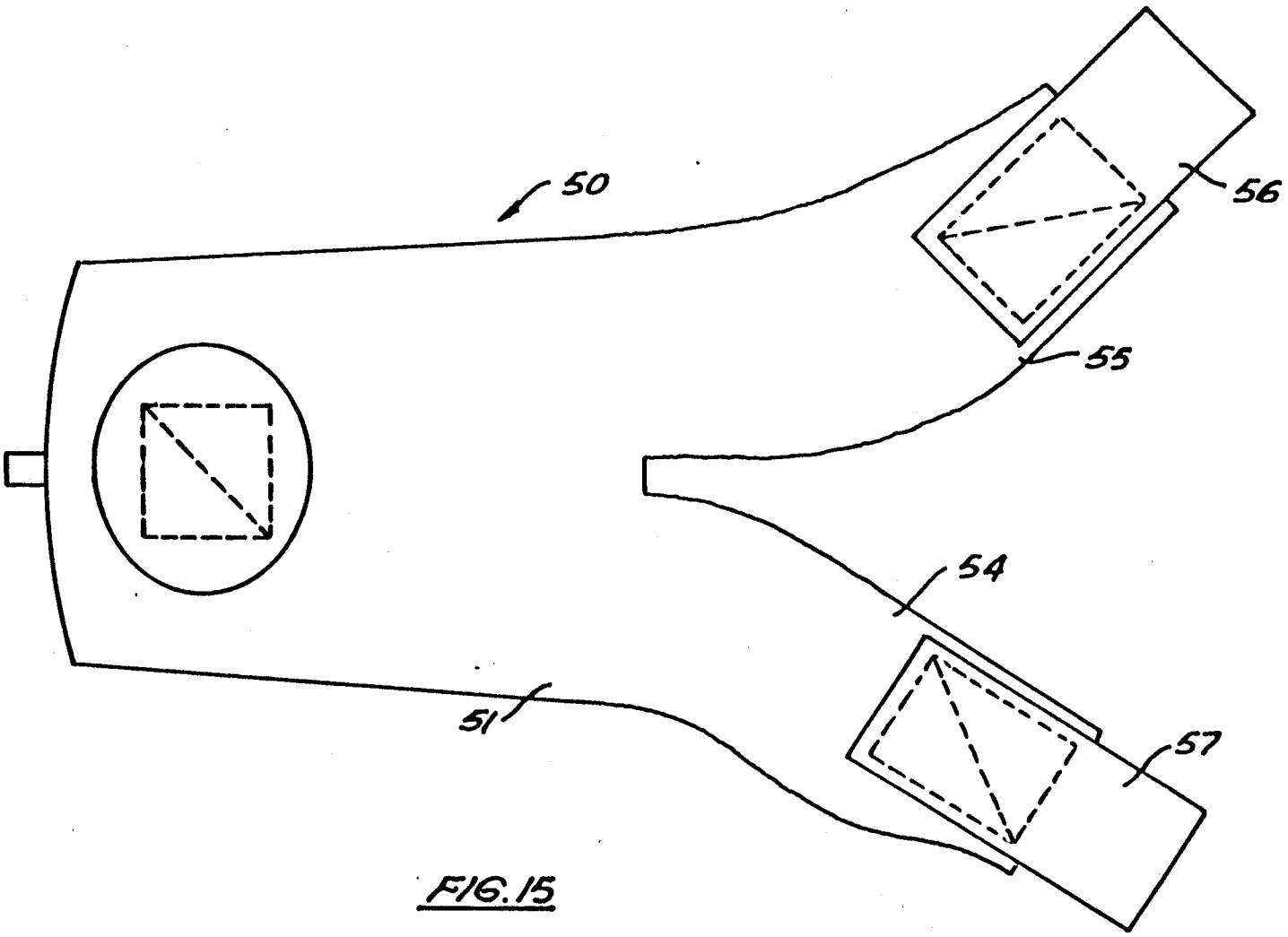
FIG. 15 is a plan view showing the reverse side of the bandage of FIG. 14.
Figure 16:
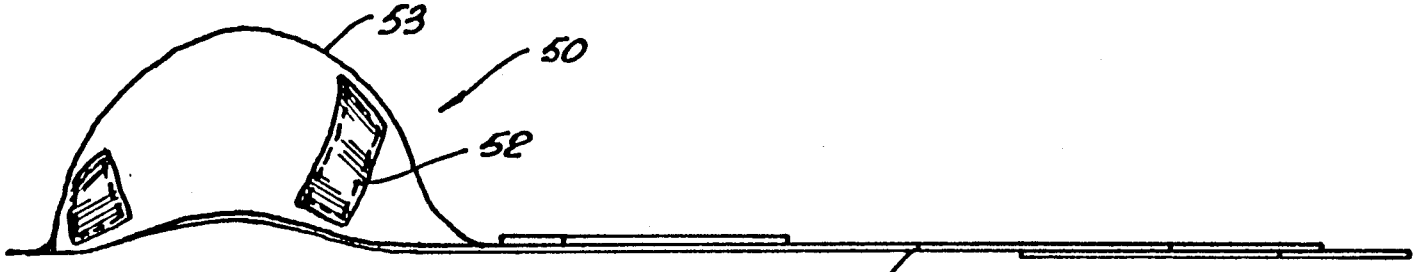
FIG. 16 is a side elevation of the bandage of FIG. 14.
Figure 17:
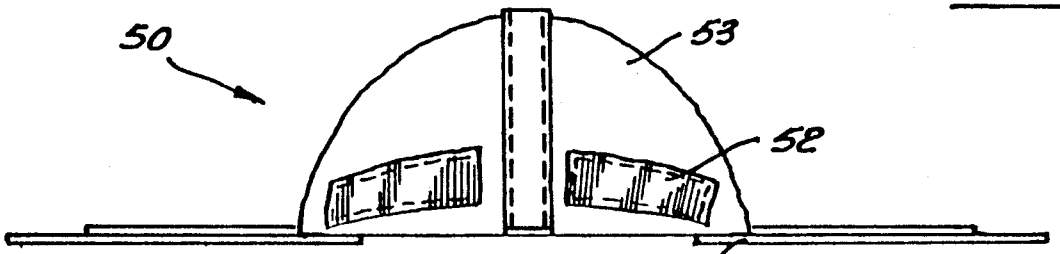
FIG. 17 is a front elevation of the bandage of FIG. 14.
Figure 18:
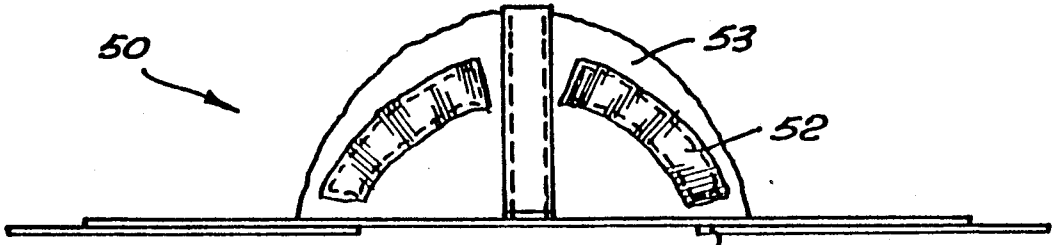
FIG. 18 is a rear elevation of the bandage of FIG. 14.

In use the bandage of the second embodiment is applied to the leg 16 of a horse as follows. Firstly, the bandage is wrapped around the animal's leg as shown in FIG. 6 with the end 23 of the bandage left free for the length of the hook zones 22. An initial wrapping of the bandage around the leg is made in an overlapping manner so as to extend downwardly to adjacent the fetlock. The end 23 is then folded downwardly over the initial wrappings as shown in FIG. 7 and the remainder of the bandage is wrapped onto the leg over both the initial wrappings and bandage end 25 in the usual partly overlapping manner so as to extend spirally from the fetlock back up to just below the knee. The end of the bandage is then secured by attaching tab 24 to hook section 25. It will be noted that as for the first embodiment the neoprene material from which the bandage is formed is elastic and it is preferably applied with some stretching so as to form a firm wrapping of bandage.

As will be apparent from the above description and drawings the bandage of the second embodiment gives a double wrapping of bandage which is considerably more supportive than that of the first embodiment described. This second bandage has been found to be particularly suitable for use with polo ponies which require not only support but also some protection from stray mallets and balls. The bandages of the first invention which are somewhat lighter have been found particularly suitable for use on racehorses.

FIGS. 9 to 13 show a bandage 30 according to a third embodiment of the invention.

The bandage 30 is formed from neoprene material and includes a flexible bulbous cup formation 31 adapted to conform to the fetlock joint 32 of a horse.

The bandage further includes an elongate extension 33 to, in use, extend upwardly from cup 31 and run lengthwise along the back of the horses leg from the fetlock 32 towards the knee.

A second substantially longer elongate portion 34 extends at right angles to extension 33 to be successively wrapped around the horses leg, and the extension 33 progressively upwardly from the fetlock joint towards the knee.

A third elongate extension 35 extends downwardly from cup 31 to be wrapped around the horses ankle immediately below the fetlock joint.

The neoprene bandage material includes a backing 36 having small loops adapted to engage with small plastics hooks of the kind used for hook and loop fastenings. The backing 36 thus provides a continuous zone of loops extending over substantially all of one side of the bandage.

A plurality of discrete hook zones 37 of the type previously described are stitched to the neoprene material on the reverse side from the looped backing 36.

In use, the bandage of the third embodiment is applied to the fetlock joint of a horse as follows. Firstly the cup formation 31 is positioned over the fetlock joint 32 to coincide with the bumper projecting behind that joint with extension 33 running along the back of the horses leg from the fetlock joint upwardly toward the knee. The extension 33 is held against the leg while elongate portion 34 is wrapped with elastic stretching around both the horses leg and extension 33. Each successive wrap partly overlaps the previous wrap so that the bandage extends spirally upwardly along the horses leg. The end of elongate portion 34 is secured to itself by means of tab 38 which contains loops to engage with complementary hook zone 39.

It will be appreciated that as the bandage is wrapped onto the horses leg with elastic stretching, each successive wrap of portion 34 partly overlies extension 33 and partly overlies the previous wrap of bandage so that the loops of backing 36 engage with some of the hook zones 37 on extension 33 and the hook zones 37 on the previous underlying wrap. In this way each successive wrap is secured under tension and the bandage is not prone to loosening when the animal is worked.

Similarly, extension 35 is wrapped below the fetlock joint, to be secured by tab 40 engaging with complementary hook zone 41 to provide firm and secure support for the joint.

FIGS. 14 to 19 show a bandage 50 according to a fourth embodiment of the invention. The bandage 50 is made from neoprene material of the kind previously described having a backing 51 providing a continuous zone of loops extending over substantially all of one A plurality of discrete hook zones 52 of the type previously described are stitched to the neoprene material on the reverse side from the looped backing 51. The bandage 50 is substantially Vee shaped having a flexible bulbous cup formation 53 adjacent one end. The end of the bandage remote from the cup 53 is divided for approximately half the length of the bandage into two diverging portions 54 and 55.

Figure 19:
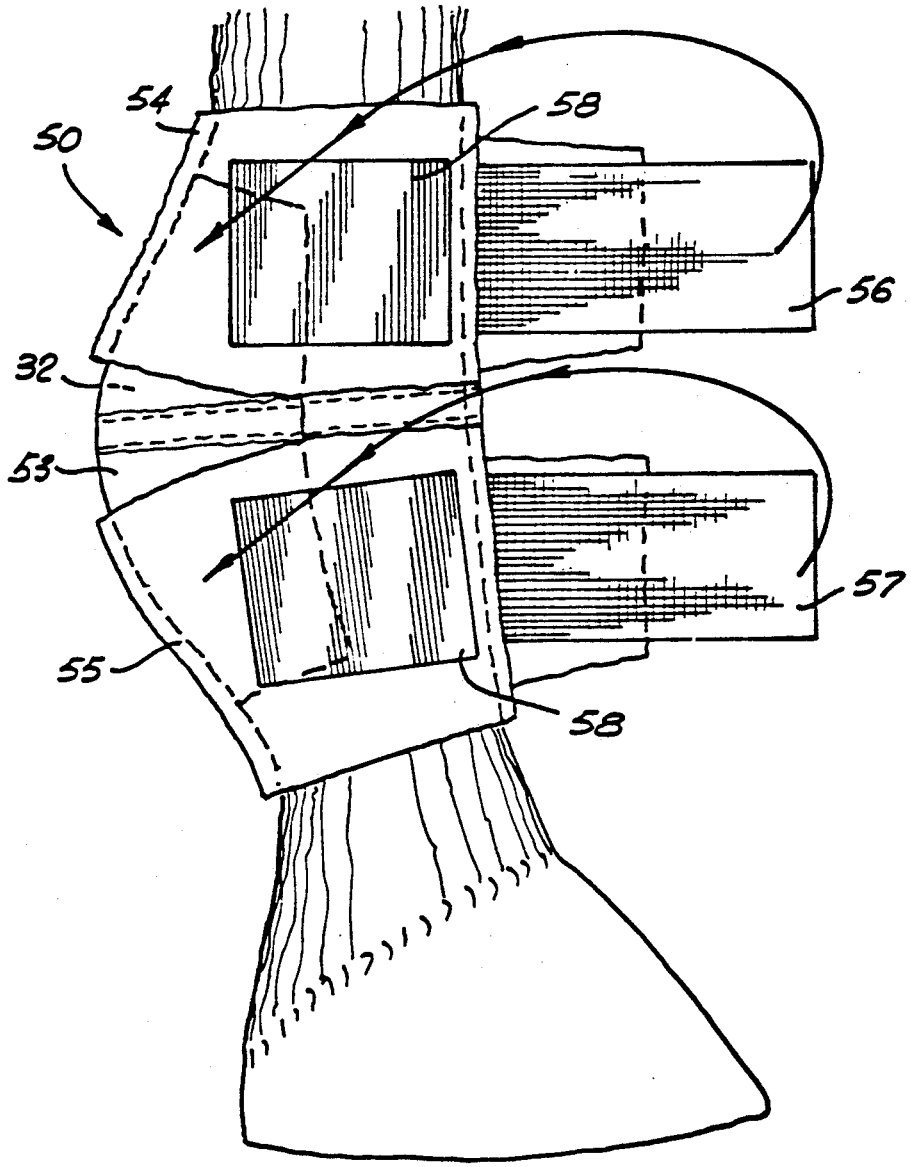
FIG. 19 shows the bandage of FIGS. 14 to 18 applied around the fetlock joint of a horse.

As shown in FIG. 19, the bandage of the fourth embodiment of the invention is applied to the fetlock joint of a horse as follows. The cup formation 53 is positioned over the fetlock joint 32 to coincide with the bumper projecting behind that joint. The diverging portions 54 and 55 are then wrapped with stretching around the fetlock joint, above and below the apex of the bumper to provide firm and secure support for the joint. As in the other embodiments, each successive wrap is secured to the previous wrap by the hook zones 52 on the previous wrap which engage with the loops on the backing 51 of each wrap. The final wraps of the tongues 54 and 55 are secured by respective projecting tabs 56 and 57 containing loop zones which engage with corresponding hook zones 58.

In this embodiment, only one layer of the bandage comprising the cup formation 53 covers the bumper of the joint entirely. The remainder of the bandage consists of the tongues 54 and 55 which are wrapped respectively above and below the apex of the bumper as shown in FIG. 19. This arrangement provides greater flexibility for the joint, while still providing support and protection.

This invention provides an equine bandage which is suitable in veterinary, exercising, training and competition applications for both protective and therapeutic functions. The bandage can be applied at the desired tension to provide the required amount of support and flexibility to suit particular applications. For example, different bandages applied at different tensions could be used when the horse is training, in competition, or recovering from an injury.

Furthermore, it will be appreciated that since each successive wrap of the bandage is secured by the hook and loop fastenings, each wrap can be tensioned individually and differently. For example, the bandage could be tightly stretched around the fetlock joint to provide support, but loosely stretched further up the horses leg, or vice versa depending on particular circumstances.

The foregoing describes only four embodiments of the invention and modifications can be made thereto without departing from the scope of this invention. For example, the zone of the loop material need not extend over the whole of one surface of the bandage but can be provided in discrete bands or zones at selected locations.

Similarly, the zones of hook material need not be continuous but can be a series of smaller spaced apart zones at selected locations. Furthermore, the resilient cup formations may be adapted for use with different equine limb joints.

The bandage may also be provided with wear resistance patches made from high strength aramid fibres such as "KEVLAR" or a similar wear resistant material. The patches can be sewn or otherwise fastened to the bandage at appropriate locations such as over the resilient cups of the third and fourth embodiments to reduce wear and prolong the life of the bandage.

Furthermore, the bandages may be of any suitable length or material to provide the required degree of support, protection and flexibility for particular applications and requirements.

I claim:

1. An equine limb bandage comprising a length of at least partially elastic flexible sheet material, said sheet material having at least one zone of loops adapted to engage at least one zone of small plastics hooks, said at least one zone of said hooks disposed thereon such that the bandage can be elastically stretched and wrapped around a horse's limb with loop zones at least partially overlying, and thus engaging, hook zones to prevent loosening of the bandage and at least a further zone of said hooks and loops disposed such that, in use, successive wraps of the bandage progressively extend along said limb and results in successive overlapping of hooks and loops so that each wrap is secured to an immediately adjacent partially underlying wrap;

wherein said bandage includes a flexible bulbous cup formation to conform to a projecting bumper associated with a limb joint, and a portion of said bandage remote from said bulbous cup formation is divided into two longitudinally extending portions to be wrapped respectively above and below an apex of said projecting bumper, one of said two longitudinally extending portions being substantially longer than the other longitudinally extending portion.

2. An equine limb bandage comprising:

a flexible bulbous cup formation which conforms to a projecting bumper on a horse's limb joint, said flexible bulbous cup formation comprising loop and hook fastener components;

flexible first and second longitudinally extending portions, said first and second extending portions extending from said bulbous cup formation and comprising loop and hook fastener components, said first extending portion being substantially longer than said second extending portion; and a flexible third elongate portion extending from said bulbous cup formation in a direction generally perpendicular with respect to said first and second longitudinally extending portions, said third elongate portion comprising loop and hook fastener components;

wherein, said flexible bulbous cup formation is positioned on said projecting bumper, said third elongate portion lies lengthwise along the limb to be bandaged, said second longitudinally extending portion is wrapped respectively below an apex of said flexible bulbous cup formation on said projecting bumper, and said first longitudinally extending portion is wrapped above said apex of said projecting bumper and successively wrapped around and along said third elongate portion so as to overlap an underlying wrap of the first longitudinally extending portion as the first longitudinally extending portion is wrapped along said third elongate portion, such that the loop and hook fastener components of the flexible cup formation, the first and second longitudinally extending portions and the third elongate portion cooperate with each other to secure the bandage on the limb.

3. An equine limb bandage according to claim 1 wherein said bandage is divided for approximately half the length thereof into the two longitudinally extending portions.

4. An equine limb bandage according to claim 1 or claim 3 wherein a third elongate portion extends generally perpendicular to said two longitudinally extending portions such that, in use, said third portion lies lengthwise along the limb to be bandaged and the longer one of said two longitudinally extending portions is successively wrapped around the along said third portion.

5. An equine limb bandage according to claim 1 wherein said bandage includes a patch made from wear resistant material to reduce wear on the bandage.

6. An equine limb bandage according to claim 1 wherein said bandage includes a continuous zone of loops extending substantially over the whole of one side thereof and a plurality of discrete hook zones spaced apart along the length of the bandage.

7. An equine limb bandage according to claim 1 wherein said flexible sheet material is formed from a synthetic rubber.

8. An equine limb bandage according to claim 7 wherein said synthetic rubber is neoprene.

* * * * *